US005321871A

United States Patent [19]

Oda

[11] Patent Number: 5,321,871

[45] Date of Patent: Jun. 21, 1994

[54] SLIDER FOR SLIDE FASTENER

[75] Inventor: Kiyoshi Oda, Toyama, Japan

[73] Assignee: Yoshida Kogyo K.K., Tokyo, Japan

[21] Appl. No.: 81,205

[22] Filed: Jun. 25, 1993

[30] Foreign Application Priority Data

Jun. 30, 1992 [JP] Japan ..... 4-045411[U]

[51] Int. Cl.[5] ..... A44B 19/00

[52] U.S. Cl. ..... 24/418; 24/387; 24/419; 70/68

[58] Field of Search ..... 24/418, 419, 421, 424, 24/429, 387, 399, 386; 70/68

[56] References Cited

U.S. PATENT DOCUMENTS 2,303,750 12/1942 Marinsky ..... 24/418

3,270,535 9/1966 Fukuroi ..... 24/387

4,438,550 3/1984 Oda ..... 24/418

FOREIGN PATENT DOCUMENTS 2340697 2/1974 Fed. Rep. of Germany ..... 24/387

*Primary Examiner*—Victor N. Sakran

*Attorney, Agent, or Firm*—Hill, Steadman & Simpson

[57] ABSTRACT

A slider for a slide fastener, comprising: a slider body including an upper wing having a cutout; a board shaped cap resiliently received in the cutout and having a claw stopper hole; a claw stopper pivotally mounted in the cap and projecting through the upper wing and into the claw stopper hole; and a resilient claw stopper support mounted on a back surface of the cap and resiliently contacting the claw stopper.

4 Claims, 3 Drawing Sheets

SLIDER FOR SLIDE FASTENER

BACKGROUND OF THE INVENTION

1. Field of the Invention

The present invention relates to a slider for slide fasteners used to join seat lining or seat covers for seats such as vehicle seats.

2. Description of the Related Art

Conventionally, sliders for slide fasteners which are to be used to join seat covers have had an inclined mountain shaped stopper claw formed in the end of the upper wing opposite to the end which goes in the closing direction. This is to say that the slider has a stopper claw which sets itself in between the fastener elements at the back opening of the fastener (Japanese Utility Model Laid-Open Publication No. Sho 51-81104).

A further kind of slider for items such as cushion covers and bed quilt covers is also well known (Japanese Utility Model Laid-Open Publication No. Hei 50-31127). Here, the outer surface of the upper wing of the slider body is flat, and there are stepped portions made in both of the outside walls of the upper wing. A pull tab then fits into these stepped portions and these stepped portions restrict the degree to which this pull tab can pivot to less than 90 degrees.

With slide fasteners for items such as vehicle head rests a slider is bulky and would get in the way so the slider is removed from the fastener chain by some means once the fastener chain has been closed. For example, the fastener chain would have a separable end assembly at one end but would not have a stopper at its other end. In this way the slider could be removed from the end of the fastener chain without a stopper once the fastener chain had been closed. A stopper such as a clip could then clinch the end of the fastener chain (Japanese Utility Model Laid-Open Publication No. Hei 3-3272).

In the example described above in the first mentioned publication, the slider described is a single body with a claw stopper formed in the upper wing of its slider body in order to provide a reverse stop function. This means that once the slider has been slid in the closing direction it cannot be slid again in the opposite direction, i.e. it cannot be moved in the opening direction. Also, as this slider is not an automatically stopping slider with reverse stopping function, it is impossible for it to be re-used.

In the example described above in the second mentioned publication, the slider described is not an automatically stopping slider and can slide freely. This means that it could easily be opened accidentally and would therefore no longer serve the purpose for which it was originally intended. Also, if the slider gets turned over sideways it is easy for the pull tab to also fall over onto its side. It would then be easy for somebody to injure his foot when he accidentally steps on the slider.

In the example described in the third publication, there is a box-shaped separable end stop assembly at one end of the fastener chain while the other end of the chain is clinched with a stopper such as a clip. The problem here is that when the slide fastener is used to seal sheets or covers, the fastener chain cannot be opened when it is time to wash the sheet or cover because of the clip so the which limits the reusability of the sheet or cover.

SUMMARY OF THE INVENTION

It is therefore the object of this invention to propose a slider to be used with slide fastener which is not like those used in conventional fastener chains. Instead, as the fastener chains used with this invention are to remain closed for long periods of time, a slider with a claw stopper which carries out a reverse stopping function to ensure that the fastener chain remains firmly in its closed position is put forward. This reverse stopping function carried out by the claw stopper can then, however, be disabled so as to enable the fastener chain to be opened in a simple manner when required.

According to this invention, there is provided a slider for a slide fastener, comprising: a slider body including an upper wing having a cutout; a board shaped cap resiliently received in the cutout and having a claw stopper hole; a claw stopper pivotally mounted in the cap and projecting through the upper wing and into the claw stopper hole; and a resilient claw stopper support mounted on a back surface of the cap and resiliently contacting the claw stopper.

For another feature, the claw stopper projecting through the upper wing allows the slider to slide in the direction of closing the slide fastener and normally prevents the slider from sliding in the direction of opening the slide fastener, the claw stopper being adapted to selectively release the slider for sliding in the direction of opening the slide fastener. For still another feature, the slider body further includes a pull guide projecting from the upper wing and having a pull guide hole in front of a central guide of the slider body.

The construction of the slider for slide fasteners in this invention is as described above. In practical use, the slider is installed onto the fastener chain closed as well known in the art. For example, when it is wished to be used with items such as sheet covers, the fastener chain is held in its closed state for a long period of time. Then when it is wished to open the fastener chain, the slider is moved in the slide fastener opening direction, i.e. backwards.

Also, when this slider with a claw stopper is slid in the closing direction, the reverse stop function does not come into operation and will only come into operation when the slider is slid in the opening direction. It is, however, also possible to slide the slider in the opening direction when necessary as the reverse stop function can be disabled in a simple manner. This means that the slider in this invention has a much wider range of application than conventional sliders as conventional sliders can only be slid in the closing direction.

DETAILED DESCRIPTION

Figure 1:
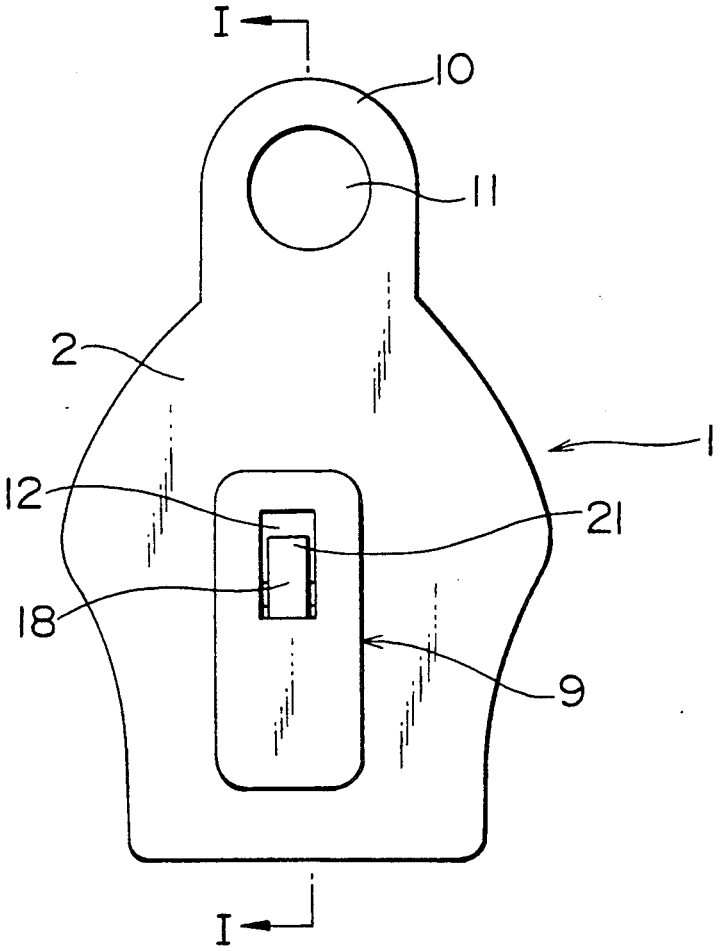
FIG. 1 is a plan view of a slider for slide fasteners.

A slide fastener slider according to one embodiment of this invention will now be described in detail with reference to the accompanying drawings.

The slider for slide fasteners in this invention consists of a slider body 1 which is preferably made of metal. An upper wing 2 and a lower wing 3 are then held a distance apart from each other by the walls of the central guide 4. A guide land 5 for guiding fastener elements protrudes from center of the inner surface of the upper wing 2 and a cutout 6 is cut out off the center line of this upper wing 2 extending inwards as far as the guide land 5. An opening 7 is made in the lower part of the cutout 6 made in the upper wing from the center of the cutout 6 toward the back opening of the slider body. Leg-shaped coupling recesses 8 and 8' with sloping walls are also formed in the front and back walls of the cutout 6 in a manner so as the cap 9 can engage smoothly with these recesses. A pull guide 10 with a pull guide hole 11 at its center is also made at the front end of the central guide 4.

Figure 4:
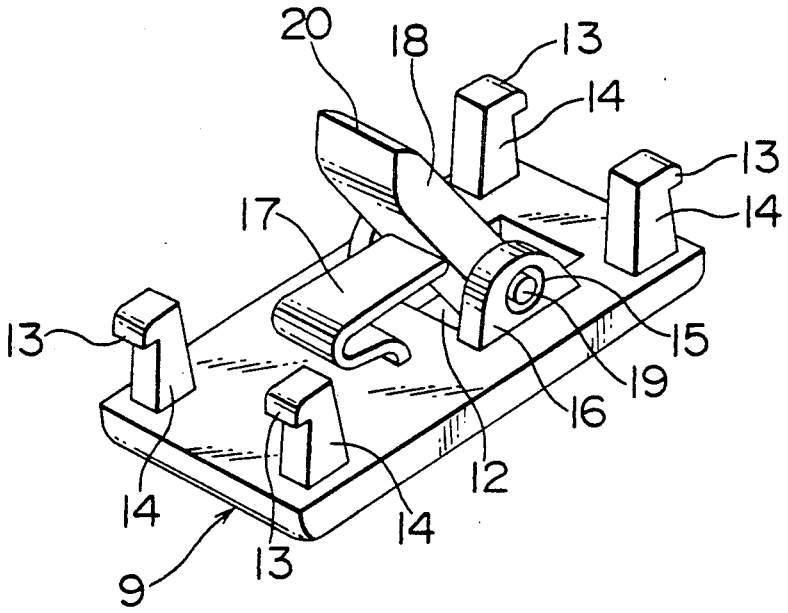
FIG. 4 is a perspective view of the underneath of a cap.

A cap 9 is a single molded body molded of a synthetic resin such as polyamide, polyacetal or polypropylene. As can be seen from FIG. 4, a claw stopper hole 12 is formed in the center of this board-shaped cap and there are clip-in legs 14 at each corner of the cap 9. The feet 13 at the ends of these legs point forwards for the clip-in legs 14 at the front of the cap 9 and backwards for the legs 14 at the back of the cap 9. Pivot shaft supports 16 with pivot holes 15 at their centers are also constructed on either side of the claw stopper hole 12 at the center of the cap 9. There is then a resilient claw stopper support 17 between the claw stopper hole 12 and the legs 14 which face down towards the back opening of the slider 1, the front end of which extends to the front of the pivot hole 15.

A long claw stopper 18 has one wedge shaped end 20, a round head shaped end 21 at its other end and has pivot shafts 19 on both sides which slot into the pivot holes 15 in the pivot shaft supports 16. The claw stopper 18 then pivots about these pivot shafts 19, with the head shaped end 21 being set into the claw stopper hole 12. One side of the portion of the claw stopper 18 which is between the pivot shaft 19 and the wedged shaped end 20 then resiliently makes contact with the front edge of the claw stopper support 17. The other side of this portion then makes contact with the edge surface of the opening 7 which is facing it. When these surfaces make contact, the reverse stop function is in operation so that the slider cannot be moved in an opening direction.

Figure 2:
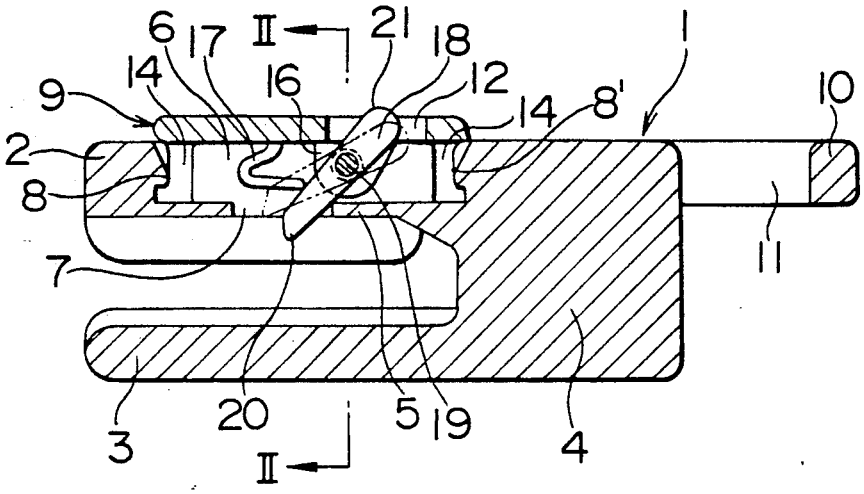
FIG. 2 is a cross-sectional view taken along line I—I of FIG. 1.
Figure 3:
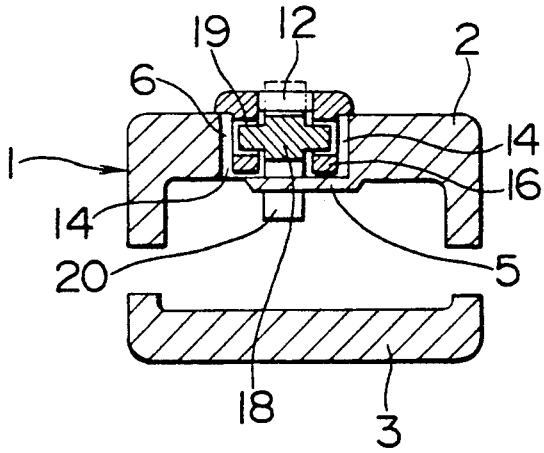
FIG. 3 is a cross-sectional view taken along line II—II of 2.

As shown in FIGS. 2 and 3, the cap 9 can be slid down into the cutout 6 so that the clip in feet 13 on the ends of the legs 14 fit into the leg shaped coupling recesses 8 and 8'. In this way the cap 9 is firmly fixed to the upper wing 2. The head shaped end 21 of the claw stopper 18 will be inclined towards the central guide 4 and the wedge shaped end 20 will protrude slightly from the opening 7 down towards the lower wing 3. The wedge shaped end 20 of the claw stopper 18 will then be able to make frictional contact with the fastener element and the front end of the claw stopper support 17 will resiliently make contact with the upper surface of the claw stopper 18. It is also convenient if the head shaped end 21 of the claw stopper 18 protrudes slightly from the surface of the cap 9.

The slider, which is shown in FIG. 2, can be slid along by inserting a rod into the pull guide hole 11 in the pull guide 10 and then pulling that rod. When the slider stops, the wedge shaped end 20 of the claw stopper 18 sets itself in between the fastener elements. As with conventional sliders, it would be possible to then move the slider along the closing direction of the fastener chain However, the reverse stop function incorporated by the claw stopper would come into operation upon any attempts to move the slider in the opening direction, i.e it would become impossible to move the slider as the wedge shaped end 20 of the claw stopper 18 would set itself between the fastener elements and the back surface of the claw stopper 18 would come in contact with the edge surface of an opening 7. When it is then desired to move the slider in the opening direction, the slider can be picked up and the head 21 of the claw stopper 18 can then be pushed down by hand into the claw stopper hole 12 in the cap 9. This will then raise the wedge shaped end 20 of the claw stopper 18 up against the resistive force of the claw stopper support 17 into the position indicated by the dash and two-dotted line in FIG. 2. It will then be possible to open the fastener chain by simply sliding the slider along the fastener chain in the opening direction.

In the slider in the embodiment shown, the cap 9 is mounted into a cutout 6 made in a portion of the upper wing 2 of the slider 1 which is off center from a central line running through this upper wing 2. However, this invention is by no means limited to the example shown and any slider which has a cap which can be secured into a cutout region in the upper wing of its slider body the cutout region of which is symmetrical with respect to a central line in the upper wing, has a claw hole positioned off center in its cap taking into account the position of the fastener element, is resilient and provides sufficient axial support is also possible.

The slide fastener slider constructed in the way described above has the following results.

The cutout 6 is formed in the upper wing 2 of the slider body 1. The board shaped cap 9 is resiliently set into this cutout 6 and a claw hole 12 is made in this cap 9. The claw stopper 18 then pivots in the cap 9 while protruding from this claw hole 12 and the claw stopper support 17 makes resilient contact with the upper surface of the wedge shaped end 20 of this claw stopper 18. The cap 9 is set into the cutout 6 so that the surface of the slider body 1 is flat. In this way a slider can be attained which differs from conventional one which has a pull tab, a pull tab lug or automatic stopper projecting on the upper surface thereof, and this slider does not give off an undesirable feeling when used with sheets and covers.

Further results are that as there is a pull guide 10 with a guide hole 11 in it protruding from the upper wing 2 of the slider body 1 the slider does not give off undesirable feelings and the closing operation is secure and simple.

What is claimed is:

1. A slider for a slide fastener, comprising:

(a) a slider body including an upper wing having a cutout;

(b) a board shaped cap resiliently received in said cutout and having a claw stopper hole;

(c) a claw stopper pivotally mounted in said cap and projecting through said upper wing and into said claw stopper hole; and (d) a resilient claw stopper support mounted on a back surface of said cap and resiliently contacting said claw stopper.

2. A slide fastener slider according to claim 1, wherein said claw stopper projecting through said upper wing allows the slider to slide in the direction of closing the slide fastener and normally prevents the slider from sliding in the direction of opening the slide fastener, said claw stopper being adapted to selectively release the slider for sliding in the direction of opening the slide fastener.

3. A slide fastener slider according to claim 2, wherein said slider body further includes a pull guide projecting from said upper wing and having a pull guide hole in front of a central guide of said slider body.

4. A slide fastener slider according to claim 1, wherein said slider body further includes a pull guide projecting from said upper wing and having a pull guide hole in front of a central guide of said slider body.

* * * * *